US008211298B2

(12) United States Patent
Pendleton et al.

(10) Patent No.: US 8,211,298 B2
(45) Date of Patent: Jul. 3, 2012

(54) CAST METAL ARTICLE AND A METHOD OF ITS MANUFACTURE

(75) Inventors: Alan J. Pendleton, Leicestershire (GB); Keith Stanley Thompson, Shropshire (GB); John Neil Pickavance, Nottinghamshire (GB); Steven Peter Baldwin, Melton Mowbray (GB)

(73) Assignee: Saint-Gobain Pam, Nancy (FR)

( * ) Notice: Subject to any disclaimer, the term of this patent is extended or adjusted under 35 U.S.C. 154(b) by 962 days.

(21) Appl. No.: 11/722,013

(22) PCT Filed: Dec. 19, 2005

(86) PCT No.: PCT/GB2005/004904

§ 371 (c)(1),
(2), (4) Date: Nov. 2, 2007

(87) PCT Pub. No.: WO2006/064276

PCT Pub. Date: Jun. 22, 2006

(65) Prior Publication Data

US 2009/0266754 A1 Oct. 29, 2009

(30) Foreign Application Priority Data

Dec. 18, 2004 (GB) ..... 0427759.6

(51) Int. Cl.
*E03F 5/06* (2006.01)
*E01C 11/22* (2006.01)
*E02D 29/14* (2006.01)

(52) U.S. Cl. ..... 210/163; 210/164; 210/232; 210/474; 210/477; 404/2; 404/4; 404/5; 404/25

(58) Field of Classification Search ..... 210/164, 210/232, 474, 477; 404/5, 25
See application file for complete search history.

(56) References Cited

U.S. PATENT DOCUMENTS

2004/0238424 A1 12/2004 Thompson et al.

FOREIGN PATENT DOCUMENTS

| | | |
|---|---|---|
| GB | 445363 | 4/1936 |
| GB | 1 230 448 | 5/1971 |
| GB | 1 541 763 | 3/1979 |
| GB | 2 120 303 A | 11/1983 |
| GB | 2 355 038 A | 4/2001 |
| JP | 8-311908 | 11/1996 |

OTHER PUBLICATIONS

U.S. Appl. No. 11/813,147, Jun. 29, 2007, Pickavance, et al.

*Primary Examiner* — Krishnan S Menon
*Assistant Examiner* — Katherine Zalasky
(74) *Attorney, Agent, or Firm* — Oblon, Spivak, McClelland, Maier & Neustadt, L.L.P.

(57) ABSTRACT

A method of manufacturing a cast article including a frame that in use of the article defines an aperture; and a further component that is in use retained moveably captive relative to the frame. The method casts the further component and respective first and second frame members, the further component and the frame members being securable together to form the article, and subsequently assembles the frame members and the further component together to form the article. A gully grate results from practicing the method.

37 Claims, 9 Drawing Sheets

CAST METAL ARTICLE AND A METHOD OF ITS MANUFACTURE

This invention relates to a cast article and its method of manufacture. Such an article includes a frame that in use of the article defines an aperture; and a further component that is in use retained moveably captive relative to the frame.

In particular but not exclusively the invention relates to such an article when constituted as a gully grate.

A gully grate typically is cast from iron, and includes a peripheral frame having protruding from a lower edge thereof an outwardly extending flange. In use of the gully grate the frame is buried in a bedding medium (such as mortar, concrete or roadstone) such that the flange defines the boundary of an aperture formed in eg. a roadway or other surface.

A reticulated grating is secured in the thus defined aperture. The purpose of the grating is to permit (typically) rainwater to flow through the aperture defined by the gully grate frame, while preventing debris, such as leaves and stones that would otherwise block a drainage system, from falling therethrough.

Very commonly the grating is hingedly secured in the frame so that it is moveable between a use position, in which it lies flush with the frame, and an open position in which it is upstanding therefrom. In the open position it is possible to insert eg. rods via the aperture for the purpose of clearing a blocked drain.

It is known to provide a security mechanism by which the grating is secured in its use position most of the time.

Typically the security mechanism comprises a tongue or other formation (known as a "spring bar") that is resiliently secured to the grating. The spring bar is engageable with a rigid tab or lug defining a shoulder formed in the frame, such that it is possible only to release the grating to its open position following application of a prising bar or similar tool to the grating to release the spring bar from the tab.

Typically the grating is hingedly secured in the frame by means of a pair of cylindrical protuberances extending from aligned locations on either side of the exterior of the grating.

One per se known way of forming the protuberances is to cast one of them integrally with one side of the grating; and insert the other in the form of a roll pin, cast pin or similar component via an aperture formed in the other side of the grating.

The roll pin is an interference fit in the aperture such that it requires force (eg. as provided by hammering) in order to insert it.

The resulting pair of cylindrical protuberances are rotatably received in hollow cylindrical recesses formed in two of the inwardly facing walls of the frame to define the hinge.

In the case of the integrally cast protuberance there are problems deriving from the tolerances required when specifying its dimensions. Consequently such a protuberance tends to come out of its frame recess, such that the grating no longer performs its intended function.

The roll pins and other types of pin can be made with greater accuracy. Roll pins, are therefore more secure but they inevitably require a manufacturing step to install them. This is costly and on occasions may have health and safety implications resulting from the need to hammer the pins into the recesses, especially if the pins are not of the (expensive) de-embrittled type.

The separately cast pins suffer from the same disadvantages as the roll pins, and additionally have a tendency to come out of the bores in which they are fixedly received.

In certain other designs the grating is secured in the frame by means of conventional nut and bolt combinations that pass through aligned eyes formed respectively in parallel limbs of the grating and in formations protruding on an inner side of the frame. Such nuts and bolts however suffer from the disadvantage of complicating the manufacture of the article. Additionally before assembly of the article the nuts and bolts can become lost or damaged, leading to further cost disadvantages.

Thus there is a need for improvements in the designs of hinges used in gully grates.

Other articles, such as but not limited to drain gratings, fire hydrant housings and water main stop-cock housings, are similar to gully grates in that they each include a frame defining typically a rectangular aperture having received therein a further component such as a grating or cover plate. It is known hingedly to secure such further components to the frames. Consequently the invention additionally relates to such articles.

One aspect of manufacture of all such articles and in particular gully grates is that it is necessary to cast the components of the article separately.

Such components typically are manufactured using the per se known technique of sand casting of molten iron. As is well known in the art of foundry practice, this process involves surrounding a pattern in a moulding box with eg. so-called green sand; processing the sand so that it adopts a semi-permanent form; removing the pattern from the moulding box; and subsequently pouring molten iron (or if required another metal) into the resulting mould formed in the sand in the box.

Following solidification of the metal the resulting cast component is then separated from the sand in the box, which latter is typically treated to allow its further use.

It is necessary from the perspective of the strength and integrity of the mould to ensure that adjacent parts thereof are spaced from one another by a substantial quantity of the sand.

This requirement hitherto has discouraged or prevented the casting of eg. the frame and the grating of a gully grate in the same moulding box, since the grating in use clears the edges of the frame by only a short distance. This distance would be insufficient, in the moulding box, to avoid collapsing of the sand. This in turn would prevent successful simultaneous casting of the components of the gully grate.

Therefore it has become common practice to mould the components of a gully grate serially. In other words, in a foundry an initial run or batch of frames is cast. Subsequently a batch of gully grates is cast.

Although this technique obviates the problems of collapsing of the sand in the moulding box, it causes further production difficulties.

The first of these is that it is necessary, on completion of a batch of frames, to stack them while awaiting completion of a corresponding batch of gully grates.

Subsequently it is necessary to attach each gully grate, using one of the aforesaid pivot member arrangements, to each frame; and before dispatch operate the securing mechanism to secure the grating in its use position.

All of the foregoing steps are time-consuming and expensive.

According to a first aspect of the invention there is provided a cast article including a frame that in use of the article defines an aperture; and a further component that is in use retained moveably captive relative to the frame, the further component including protruding therefrom on opposite sides a pair of respective protuberances each rotatably received in a corresponding, closed-sided recess defined in the frame, the frame being assembled from first and second frame members the first of which includes formed therein substantially coinciding with the in-use location of at least one of the protuberances an open-sided recess having an opening in a side thereof; and the second of which includes protruding therefrom a closure that closes the opening in the side of the open-sided recess to define a said closed-sided recess.

Forming the frame from first and second frame members allows the use of an assembly process that is efficient and reliable. Such a process includes, at a first stage of assembly, locating two protuberances protruding from the further component in respective recesses formed in the first frame member. At least one and in preferred embodiments both of the recesses are open on at least one side, whereby insertion of the protuberances is a quick, safe operation that does not involve hammering. Subsequently the second frame member is secured to the first frame member so as to close off any open sides of the recesses, thereby causing the protuberances to be rotatably retained therein.

Thus the manufacturing cost of the article is reduced. Simultaneously the precision of the hinge may be improved, even when the protuberances forming part of the hinge are cast integrally with the further component.

Preferably the first frame member includes formed therein two open-sided recesses each having an opening in a side thereof and respectively substantially coinciding with the in-use locations of the pair of protuberances; and the second frame member includes protruding therefrom a pair of closures that respectively close the opening in a side of a said open-sided recess thereby defining a pair of the closed sided recesses.

Such an arrangement is particularly simple to assemble from component parts.

Conveniently the first frame member includes formed therein one or more slots, that are each open at an edge of the first frame member, having received therein a part of the second frame member so as to locate the second frame member relative to the first frame member. Such slots facilitate assembly of the first and second frame members together, thereby further advantageously improving the efficiency of the assembly operation.

Conveniently the first and second frame members are secured, especially welded, one to the other. This feature assures that the article is adequately robust for its intended use. Typically this will involve installation of the article in a roadway.

Conveniently the first frame member defines two frame arm ends; and the said second frame member includes one or more formations that are engageable with the first frame member to determine the spacing of the said second frame member relative to the frame arm ends of first frame member. This allows the construction of the article in any of a plurality of forms, as explained in more detail hereinbelow.

Preferably the second frame member includes at either end a cranked portion defining respective said formations, whereby a major part of the second frame member lies generally coterminous with the frame arm ends thereof.

When the cast article is a gully grate, the foregoing feature advantageously permits it to be installed adjacent a kerbstone or similarly rigid roadway margin while maintaining good draining characteristics.

Alternatively the second frame member optionally includes at each end a planar portion defining respective said formations whereby the second frame member is spaced from the frame arm ends.

This arrangement means that no part of the first frame member extends laterally beyond the second frame member. This renders the cast article, when constituted as a gully grate, particularly suitable for installation at the edge of a roadway having a soft margin such as a grass verge.

Preferably the further component is or includes a reticulated grating. This renders the article particularly suited to function as a gully grate.

When so configured, optionally the reticulated grating is defined at least in part by one or more elongate members that are arranged in a reticulated pattern. Preferably then the second frame member includes protruding therefrom towards the grating one or more pattern-continuing protuberances that continue at least part of the reticulated pattern beyond the extent of the grating.

Such features assure that even if the grating terminates short of the second frame member (to allow clearance for opening the grating) the reticulated pattern is substantially uninterrupted. Therefore the advantages of providing the grating arise notwithstanding the structure adopted.

Also preferably, when the second frame member is spaced from the frame arm ends, the second frame member includes protruding therefrom away from the grating one or more gap-reducing protuberances.

By "gap-reducing protuberances" is meant any protuberance that reduces the overall dimensions of any space between the second frame member and eg. a kerb or one of the frame arm ends, compared with the size of gap that would result in the absence of such a protuberance.

Gap-reducing protuberances are particularly desirable to minimise the risk of bicycle wheels becoming stuck in such gaps.

Conveniently the first member of the cast article includes a flange extending outwardly of the periphery of the frame.

Optionally the second frame member also includes a flange extending outwardly of the frame.

The width of the flange may vary from place to place about the periphery of the frame. Furthermore optionally the or a said flange may include formed thereon one or more protrusions and/or recesses for stiffening the article and for aiding keying of the flange in a bedding medium.

Even more preferably the protrusions and/or recesses are formed on an in use upper surface and/or an in use lower surface of the flange.

The foregoing features of the cast article according to the invention advantageously provide for highly effective keying in the ground, or another medium, of an adequately stiff structure.

Preferably, when the cast article is a gully grate, a said frame member thereof includes formed therein at least one support and the said further component includes at least one formation for engaging the support when the further component occupies a first position relative to the frame.

Thus any forces transmitted via the further component (grating) are reacted by the or each support, in a predictable manner.

Conveniently a said frame member and the further component define a detent for releasably retaining the further component in a first position relative to the frame.

Preferably the further component includes a resiliently deformably mounted tongue and the frame includes a lug with which the tongue is selectively engageable releasably to retain the further component in the said first position.

In one embodiment of the invention the first frame member of the article defines a pair of arm ends and the second frame member includes formations engaged with the first frame member so as to space the second frame member from the frame arm ends.

Alternatively the first frame member may define a pair of arm ends and the second frame member may include formations engaged with the first frame member such that the second frame member and the frame arm ends are substantially coterminous.

According to a second aspect of the invention there is provided a method of manufacturing a cast article including a frame that in use of the article defines an aperture; and a further component that is in use retained moveably captive relative to the frame, the method comprising the steps of:

(i) casting the said further component and respective, first and second frame members, the said further component and the frame members being securable together to form the article; and (ii) subsequently assembling the said frame members and the further component together to form the article.

Surprisingly, and contrary to the trend in manufacturing generally, it has been found that increasing the number of components from which the article is manufactured, by casting the frame initially in the form of first and second frame members that are subsequently secured together, leads to very significant improvements in the efficiency of the manufacturing operation.

Preferably but not essentially the further component and the first and second frame members are cast substantially simultaneously.

Thus the casting of the frame in the form of first and second frame members permits the simultaneous casting, in the same moulding box, of both the frame and the grating of a gully grate.

This is because the separation of the frame into two members allows the manufacturer to maintain an adequate spacing between the parts of the article, during moulding, so as to avoid the aforementioned problem of collapsing of the sand mould.

Since the parts of the article are manufactured simultaneously, the overall time to manufacture an article is greatly reduced compared with the above-described prior art method. Moreover, use of the method of the invention avoids the need to store completed frames pending manufacture of gratings for insertion therein.

In the preferred embodiment of the method of the invention the frame is the frame of a gully grate; and the further component is the grating of a gully grate, the grating being moveably securable in the frame on assembly of the article.

However, as indicated herein, the method of the invention is equally applicable to other cast items in which a grating or further component is in use moveably secured to a frame defining an aperture.

Preferably the step (ii) includes adhering, especially welding, the first and second frame members one to the other on assembly of the components of the article together.

Even more specifically the method includes the sub-step of welding the first and second frame members together along at least one seam defined on assembling of the first and second frame members together.

The foregoing steps are advantageously quick and cheap to effect in a foundry. As an alternative to welding, however, an adhesive compound may be used for the purpose of securing the first and second frame members one to the other.

In a particularly preferred embodiment of the invention the frame is polygonal and the second frame member defines on assembly of the article one of the sides of the polygon.

Thus the method of the invention is advantageously suited to the manufacture of a gully grate the frame of which defines a rectangular opening.

More specifically the first frame member preferably defines a major part of the periphery of the frame; and the step (i) includes casting the further component in a space that is defined at least in part on casting of the first frame member.

This feature of the method further helps to permit the casting of all the components of the article in a single mould box, while maintaining adequate spacing between the cast parts.

Also, preferably the further component and the first frame member are cast in a relative orientation that differs from their relative orientation on assembly of the frame members and the further component together to define the article.

In other words, the shapes and dimensions of the first frame member and the further component are chosen such that in one relative orientation (ie. the orientation adopted in the moulding box) the further component fits within the "footprint" of the first frame member with an adequate clearance to permit maintenance of the structure of the sand mould; and in another orientation (ie. the use orientation) the further component fits within the first frame member with a smaller clearance.

This is achieved by reason of the first and second frame members, when the article is assembled, defining a rectangular opening; and the further component being generally rectangular in shape and receivable in either of two mutually orthogonal orientations in the space defined on casting of the first frame member.

It is particularly preferable that the first and second frame members, when the article is assembled, define more specifically a square opening. Such an arrangement assists in permitting the further component to fit within the first frame member in either of two relative orientations.

Conveniently the further component includes one or more protuberances that are each receivable in a respective, open-sided recess having an opening in a side thereof formed in the first frame member; and the second frame member includes a respective closure for closing each said opening, the step (ii) including inserting the or each said protuberance into a said recess; and subsequently causing a said closure to close each said recess with the protuberance received in the recess.

This arrangement advantageously permits the creation of a hinge securing the further component to the frame. The hinge is assembled in a permanent manner by reason of, during step (ii) of the method, the closures being fixed in place to secure the respective protuberances in their recesses.

In order to provide an advantageously robust and simple hinge arrangement, preferably each said protuberance is a trunnion and each said recess defines a journal in which the trunnion is rotatably received.

The method of the invention furthermore embraces within its scope the step of casting a pair of the articles simultaneously in a single moulding box.

In this aspect of the method the first frame members of the respective pairs may be cast side by side, with associated said further components cast in the spaces defined therein. The second frame members (which preferably are substantially elongate plates) are each cast parallel to an edge of a said first frame member, thereby maximising the usage of the moulding box per casting cycle.

When casting a pair of the articles simultaneously as aforesaid of course it is possible for the articles to be identical to one another. However, in a variant it is optionally possible that the second frame members of the pairs of articles differ from one another.

By employing this step it is possible to produce two different cast articles simultaneously. Depending on production requirements, such method features may be desirable.

Preferably in accordance with the method of the invention each first frame member of each pair of articles defines two frame arm ends; the second frame member of the first article of the pair includes one or more formations that space the said second frame member relative to the frame arm ends of the first frame member by a predetermined distance on assembly of the first article; and the second frame member of the second article of the pair omits such formations whereby to confer a different spacing, relative to the frame arm ends, on assembly of the second article of the pair.

More preferably the second frame member of the first article of the pair includes at either end a cranked portion defining respective said formations, whereby on assembly of the first article of the pair a major part of the second frame member thereof lies generally flush with the frame arm ends thereof.

There now follows a description of preferred embodiments of the invention, by way of non-limiting example, with reference being made to the accompanying drawings in which.

Figure 6A:
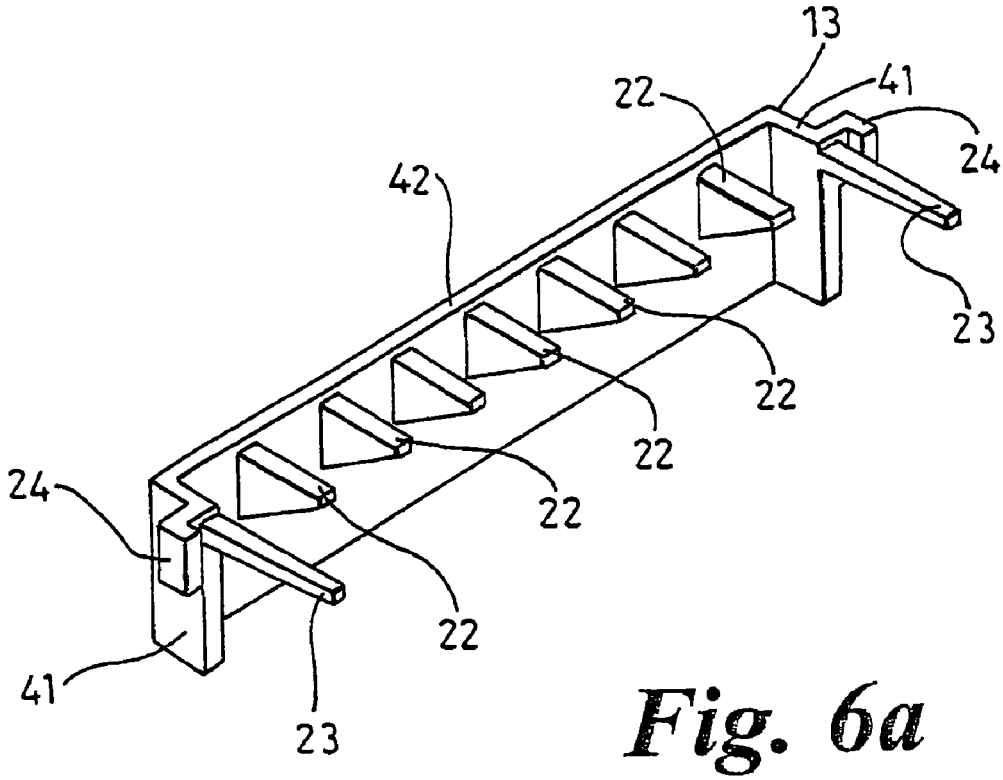
Figure 6B:
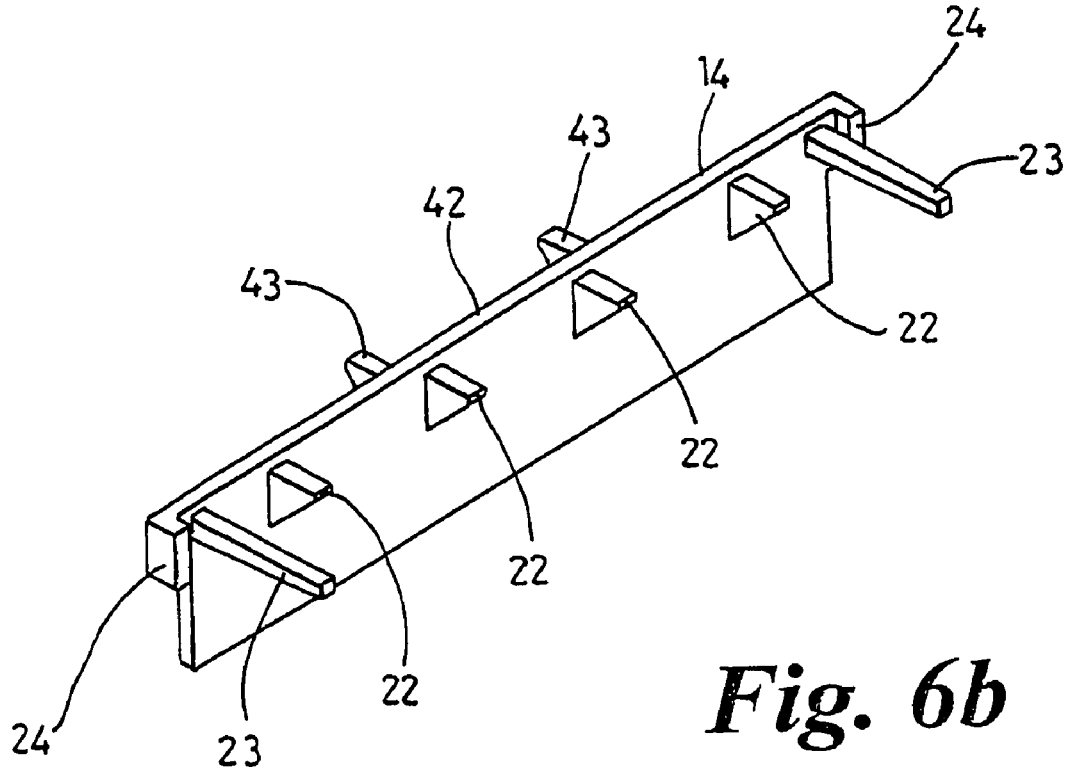
Figure 7:
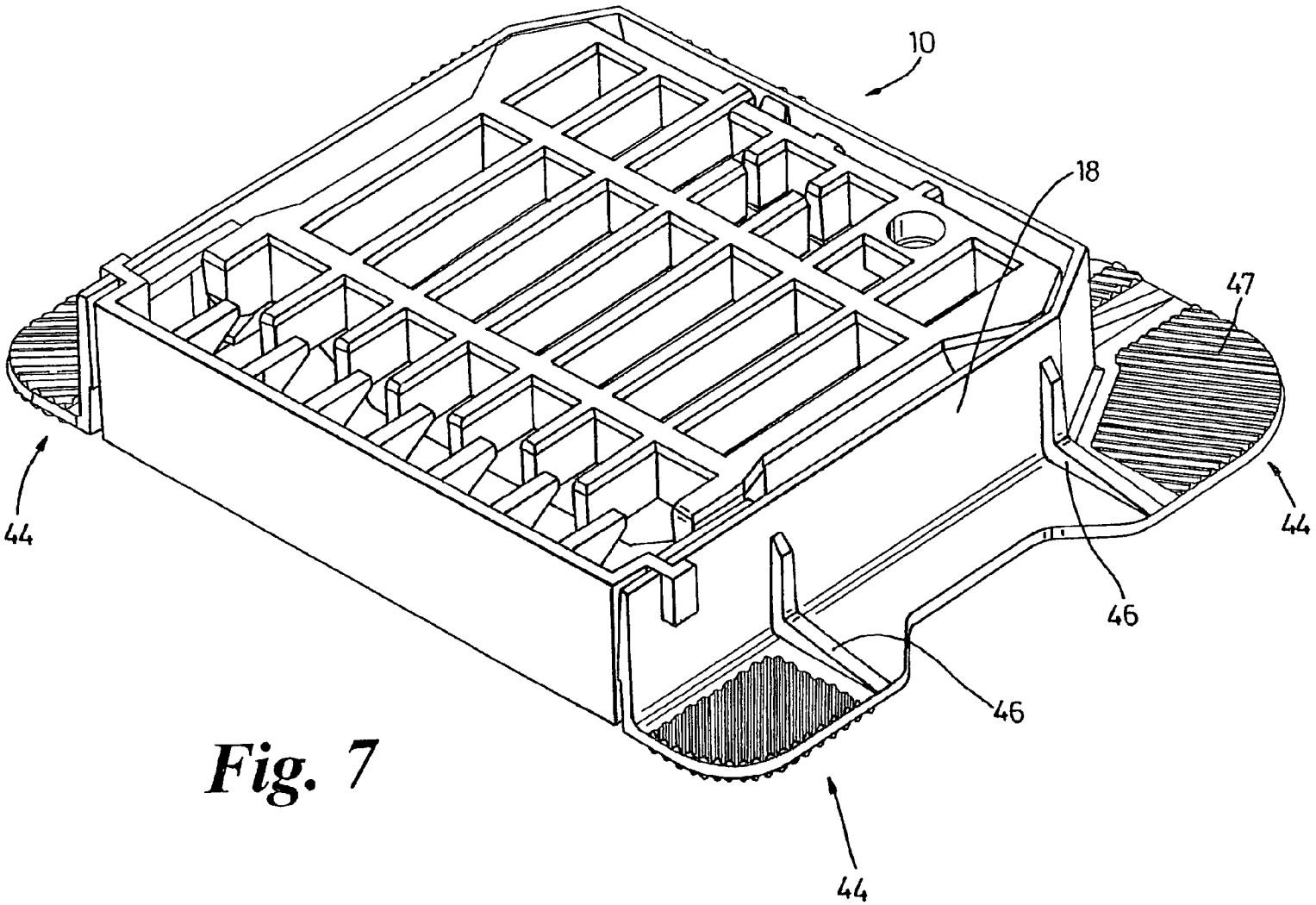
Figure 8:
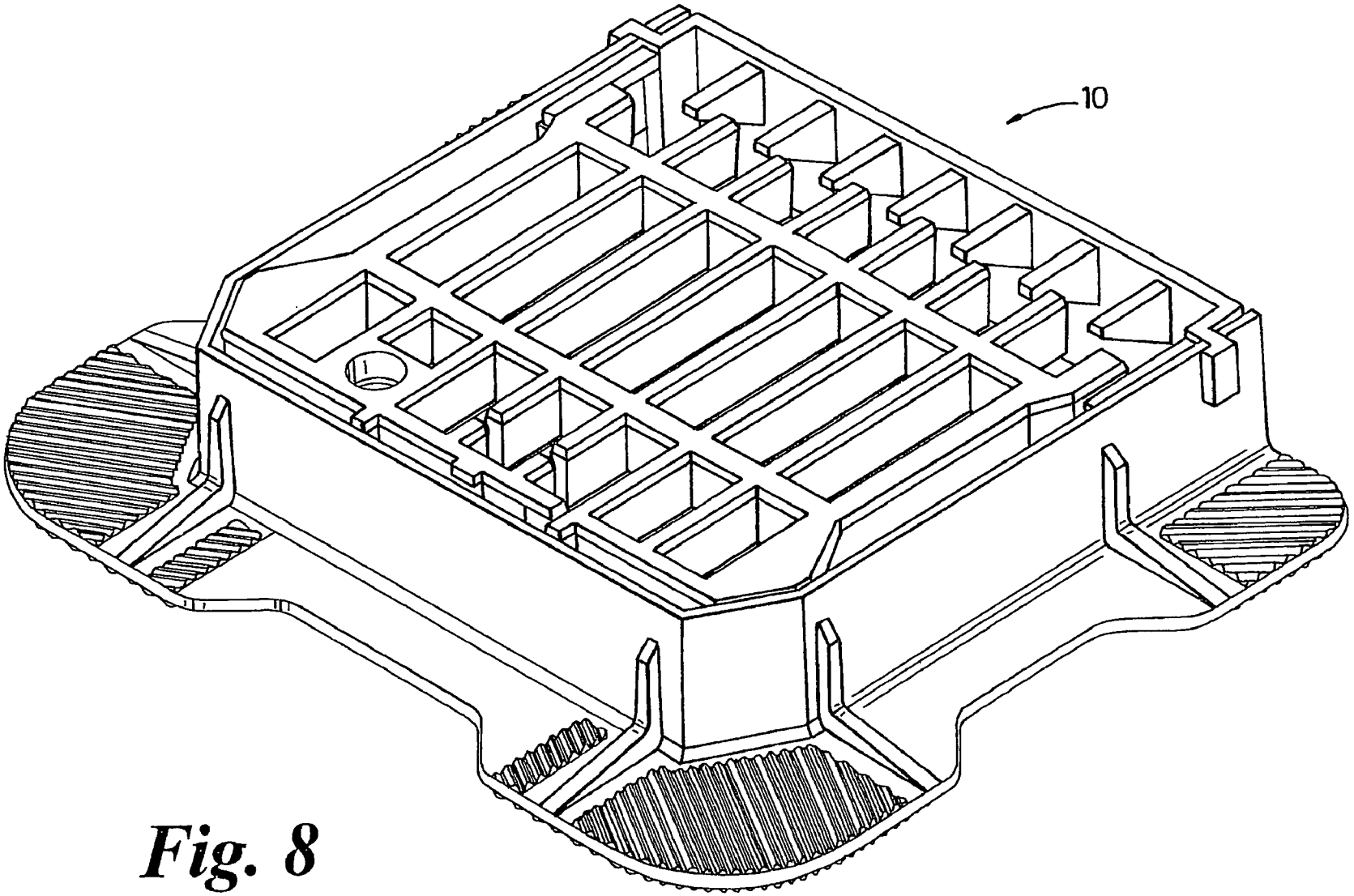
Figure 9:
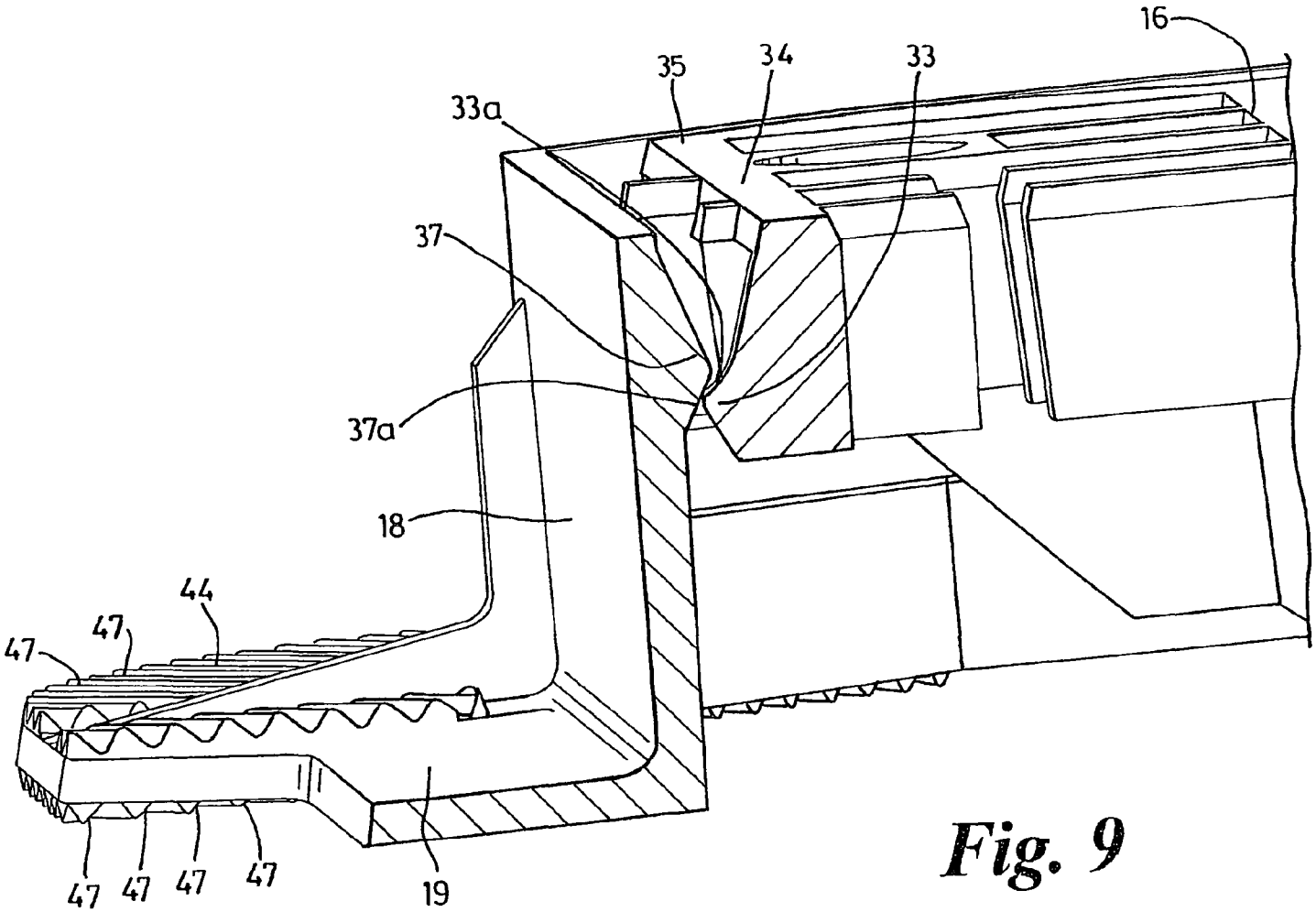

FIGS. 6*a* and 6*b* respectively are perspective views of different types of second frame member manufactured in accordance with the method of the invention;

FIG. 7 shows from a first side in perspective view an assembled gully grate according to the invention;

FIG. 8 shows the FIG. 7 assembly from another side generally opposite the first side; and FIG. 9 is a perspective, partly sectioned view showing the manner of operation of a detent defining a security mechanism according to the invention.

Figure 1:
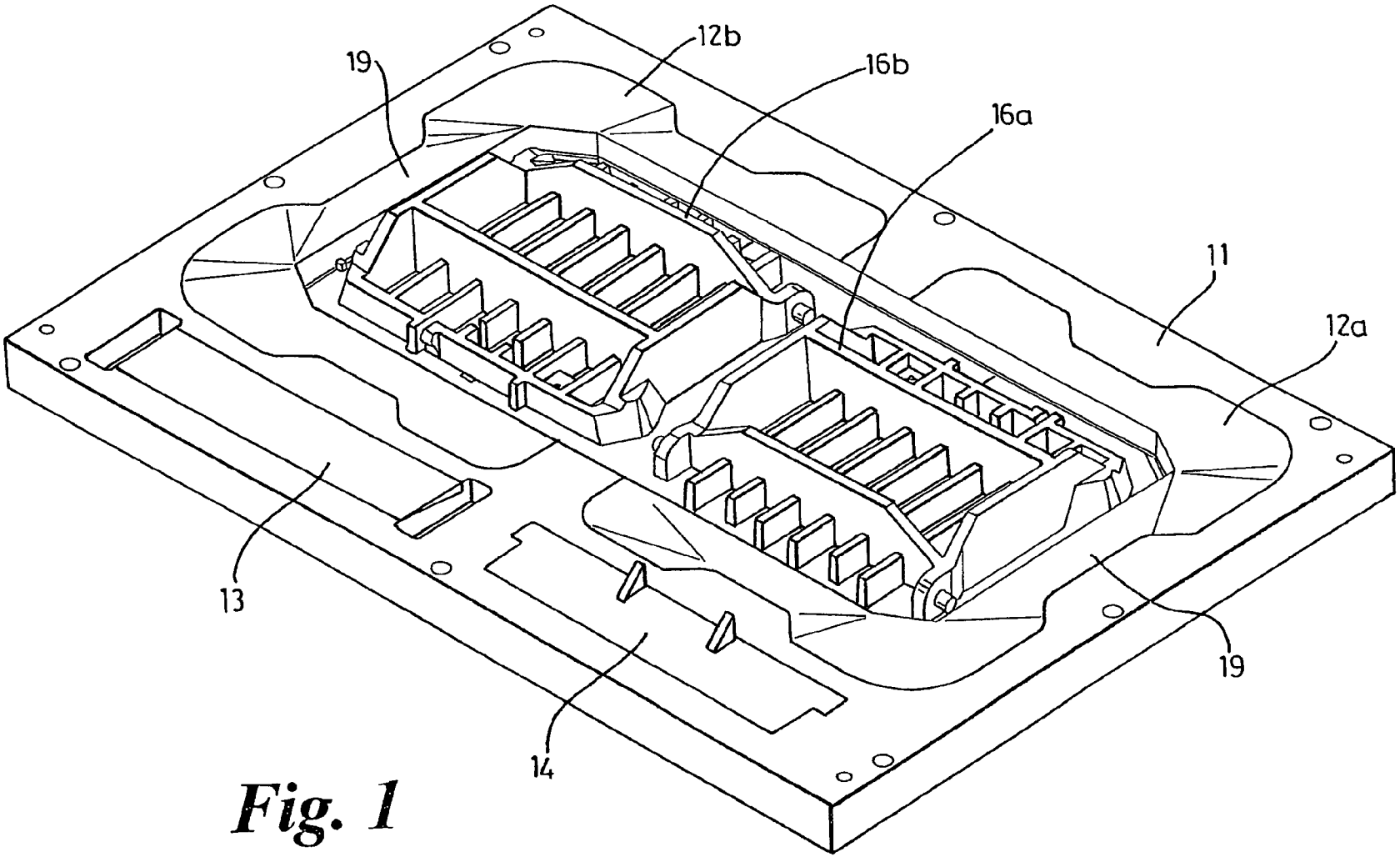
FIG. 1 is a perspective view from one side of a pattern plate used in a method according to the invention to manufacture of pair of cast articles.
Figure 2:
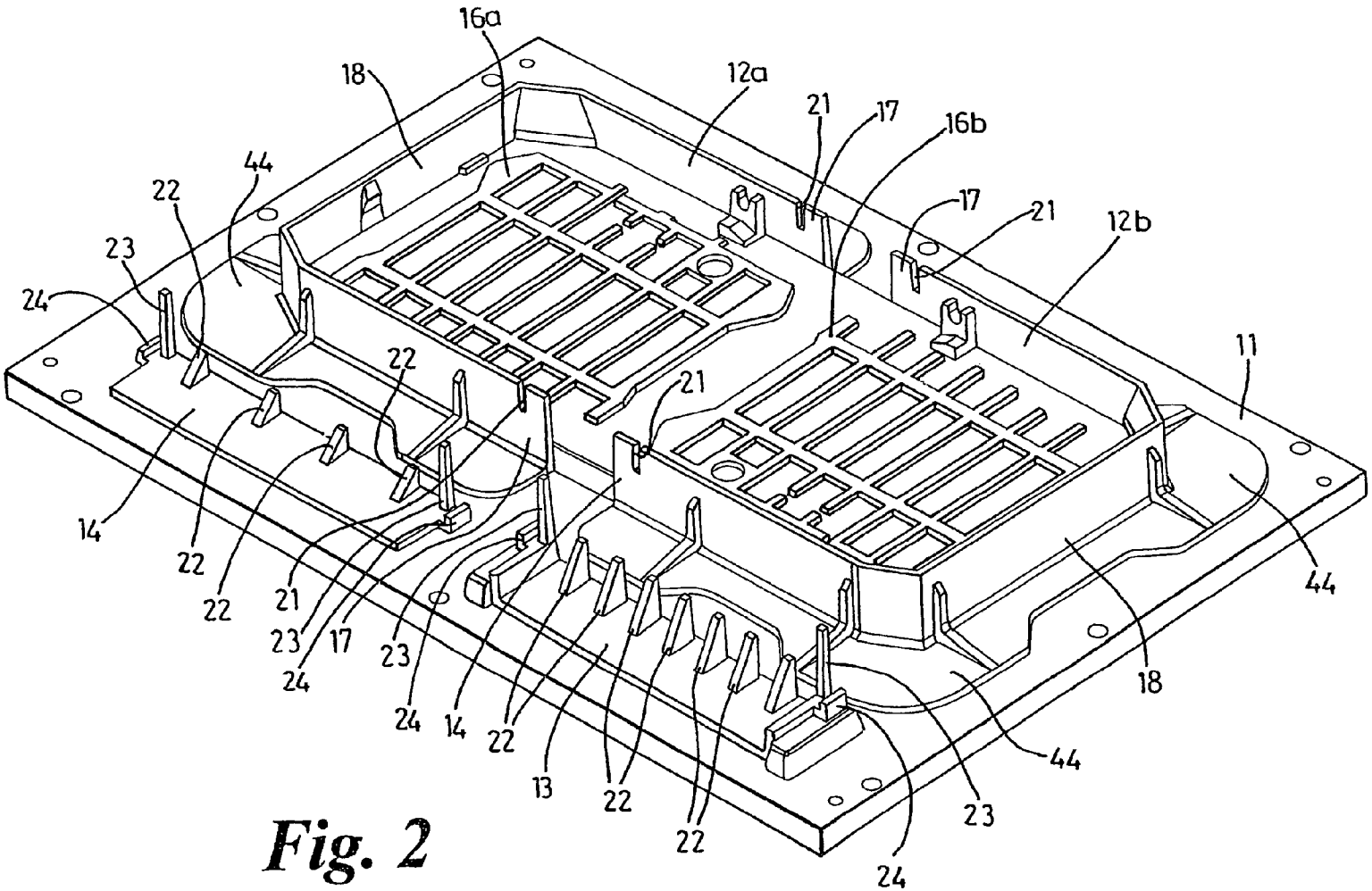
FIG. 2 is a perspective view of the pattern plate of FIG. 1 from the other side.

FIGS. 1 and 2 of the accompanying drawings show, part way through a manufacturing procedure, the components of a gully grate 10 that is described in its assembled condition hereinbelow with reference to FIGS. 7 and 8.

FIGS. 1 and 2 show patterns for casting the components of the gully grate 10. The shaded regions of FIGS. 1 and 2 represent the pattern plate arrangement, with the patterns mounted on them.

The figures for clarity omit the walls of the moulding box, the nature of which will be known to those of skill in the relevant art. Such omission is necessary in order clearly to show the layout of the subcomponents from which the article 10 is manufactured, during the casting process.

As explained hereinabove, the essential steps in the technique of sand casting involve, firstly, placing a pattern as shown in FIG. 1 in a moulding box, and surrounding the pattern with a quantity of moulding sand.

Thereafter the moulding sand is typically compressed into the moulding box such that the pattern may be removed from the moulding box without fear of the sand collapsing.

These steps result in a sand mould, into which during the casting process molten metal is poured. Following solidification of the metal the sand may be separated from the resulting, cast components which may then be allowed to cool or may undergo further manufacturing processes such as but not limited to de-flashing and assembly steps. The sand may then be re-cycled by "freshening" it with further quantities of its ingredients (that typically are a mix of sand, clay and water).

FIGS. 1 and 2 show the pattern plate for forming the mould in the moulding box.

As would be evident to one of skill in the relevant art, FIGS. 1 and 2 signify simultaneous casting of the subcomponents of the article.

The components produced using the pattern plate arrangement of FIGS. 1 and 2, which are shown in FIGS. 3 to 6 comprise a pair 12*a*, 12*b* of substantially identical first frame members; a pair of non-identical second frame members 13, 14 and a pair of substantially identical further components in the form of gratings 16*a*, 16*b*. The patterns in FIGS. 1 and 2 are, for convenience, identified by the same reference numerals as their counterpart, cast components in FIGS. 3 to 6.

Thus the group of subcomponents as cast in a preferred version of the method of the invention is suitable for subsequent assembly into a pair of non-identical gully grates similar or identical to gully grate 10 described in more detail hereinbelow. However, of course if desired the first frame members 12*a*, 12*b* may differ from one another in ways that will occur to those of skill in the art.

Such assembly of each set of subcomponents referred to herein more generally by the numerals 12, 13 or 14 and 16, as appropriate results in the grating 16 being moveably retained relative to a frame constituted by a said first frame member 12 and one of the second frame members 13, 14.

Figure 3:
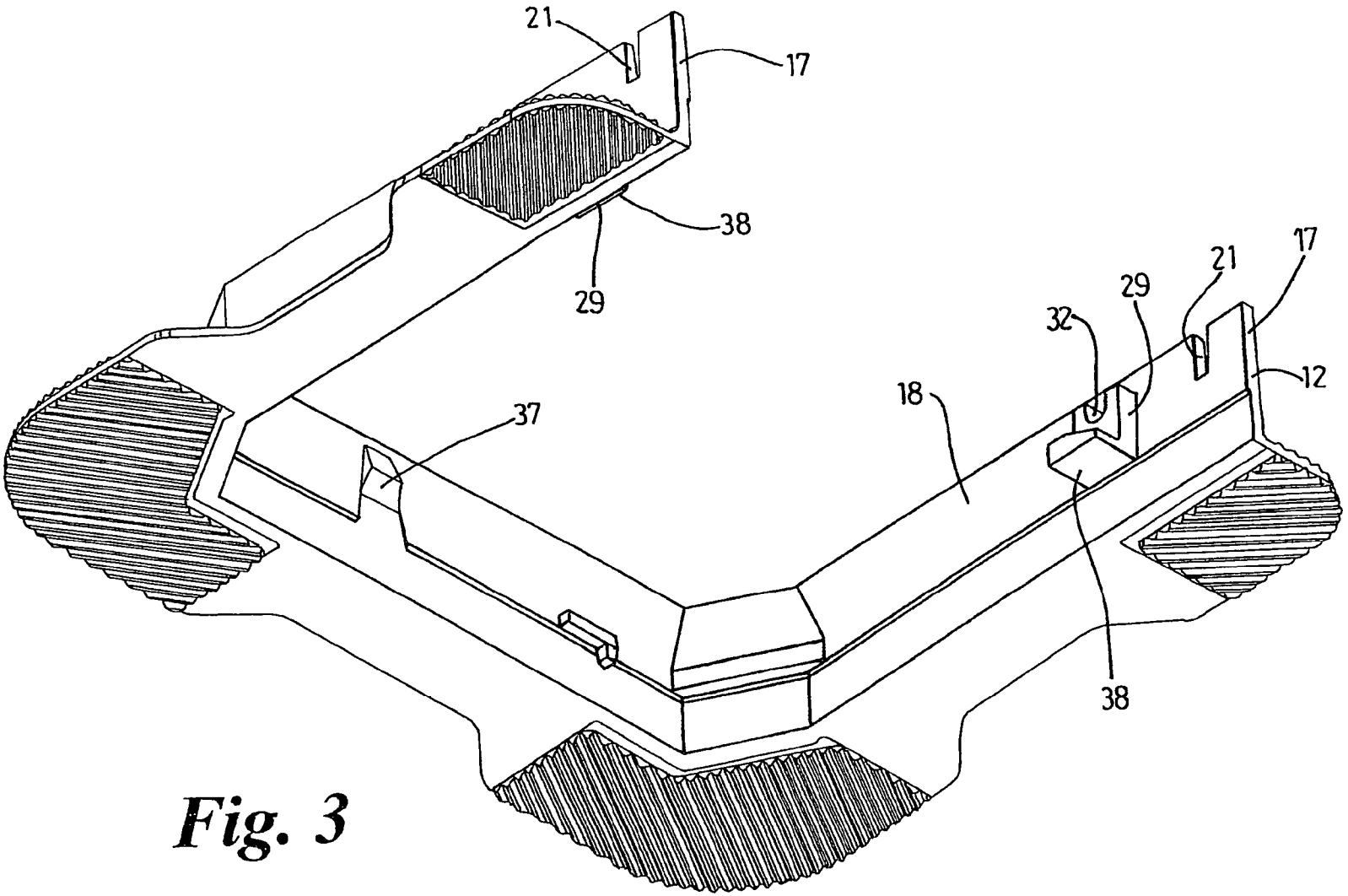
FIG. 3 is a perspective view from below of a first frame member manufactured in accordance with the method of the invention.

As is best seen in FIG. 3, each first frame member is generally U-shaped, and includes a generally continuous wall 18 that is upstanding from a flange 19 protruding from the exterior of the wall 18.

The limbs of the U shape define respective frame arm ends 17. As is best seen in FIG. 3, a notch or slot 21 extending from the free upper edge of the wall 18 part-way towards the flange 19 is formed in each frame arm end 17 spaced a short distance from its free end.

Each of the second frame members 13, 14 is in essence a flat plate having protruding from one side a series of pattern-continuing protuberances in the form of teeth 22 flanked at either end of the plate by an elongate, protruding closure member 23, the function of which is described hereinbelow.

Each of the second frame members 13, 14 terminates in an upper part of its lateral extent outwardly beyond the closure members 23 at either end in a lug 24 defined as an L-shaped region of metal one limb of which protrudes in generally the same direction as the teeth 22 and closure members 23.

The location and dimensions of the slots 21 and the lugs 24 are such that the lugs may be slotted from above into the slots 21 thereby locating each said second frame member 13, 14 relative to a said first frame member 12*a*, 12*b*. When thus assembled together the first and second frame components may then be permanently secured together preferably by welding along the seams defined by the lugs 24 and slots 21, or possibly through the use of a high strength adhesive.

As is clear from the drawings, in the preferred embodiment of the invention the frame is polygonal and the second frame member 13 or 14 defines one side of the polygonal shape which in the embodiment shown is rectangular, especially square. The first frame member 12*a*/12*b* defines a major part of the periphery of the frame.

As is apparent from FIGS. 1 and 2, the grating 16*a*/16*b* defining the further component of the cast article is cast in the space that is defined between the arms of the U-shape of each first frame member 12*a*/12*b*.

This is an efficient use of the space in the moulding box and is possible because the relative orientation of the gratings 16 relative to the first frame members 12*a* and 12*b* differs from the orientations that they adopt in use when assembled into the gully grate 10.

In particular, each grating 16*a*/16*b* is in the orientation represented by the pattern of FIGS. 1 and 2 rotated 90° relative to the orientation that it would adopt in the assembled article.

It follows from this that in practice each grating 16*a*/16*b* is receivable in either of two orientations in the generally rectangular space defined between the arms of the U-shape of the first frame members 12*a*/12*b*. In the as-cast orientation represented by the pattern of FIGS. 1 and 2 there is considerable space between the periphery of each grating 16 and the upstanding wall 18 of the first frame member 12*a*/12*b* adjacent which it is cast. Then it is rotated through 90° in the same plane, however, each grating 16 is receivable between the limbs of the first frame member with only a comparatively small clearance at its lateral edges thereby rendering the arrangement suitable to serve as the openable grating in a gully grate.

These features of the grating 16 and first frame members 12*a*, 12*b* are facilitated by the fact that the opening defined by the frame of the gully grate 10 is generally rectangular in shape, as is the "footprint" of the grating 16.

Figure 4:
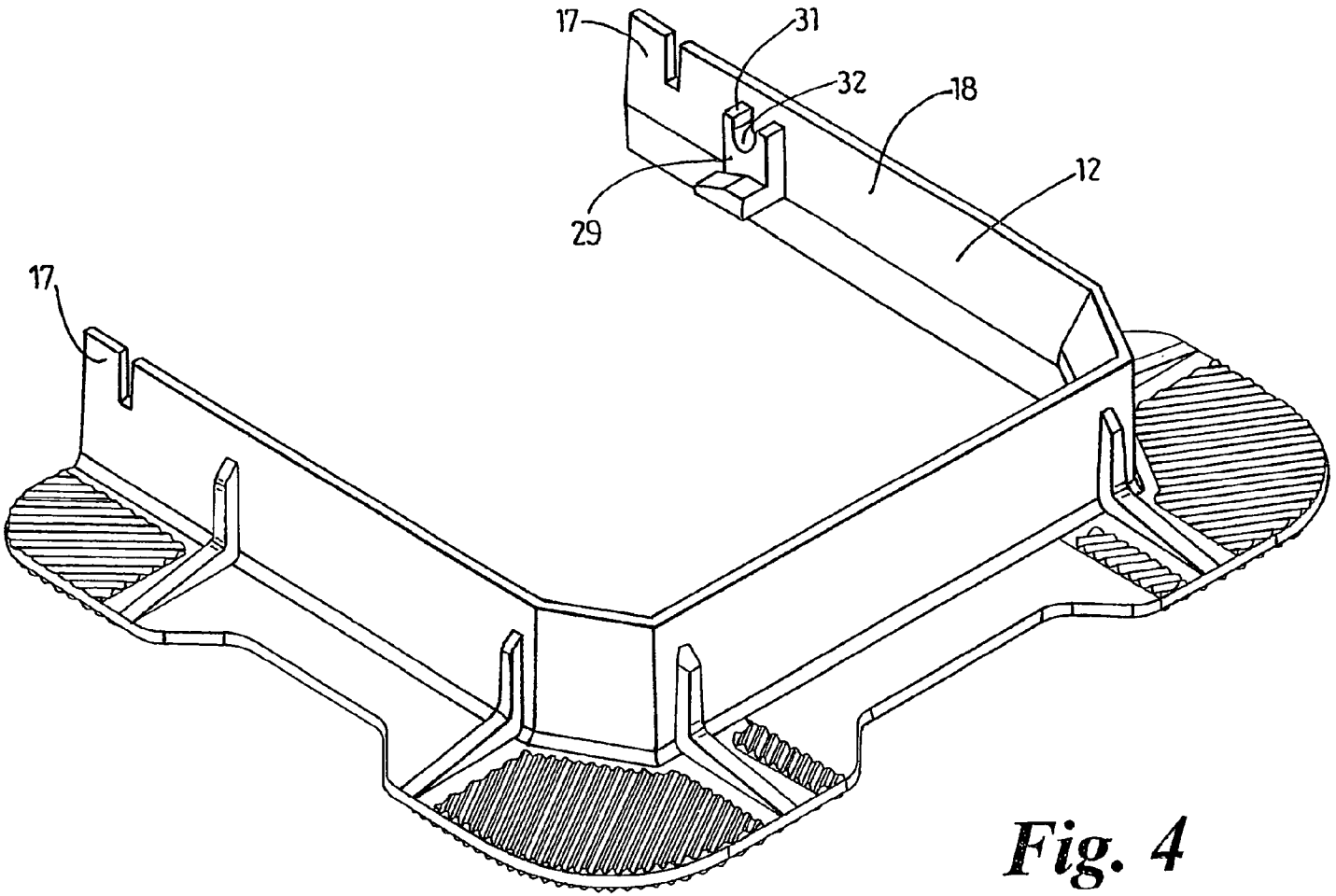
FIG. 4 is a perspective view from above of the first frame member of FIG. 3.
Figure 5:
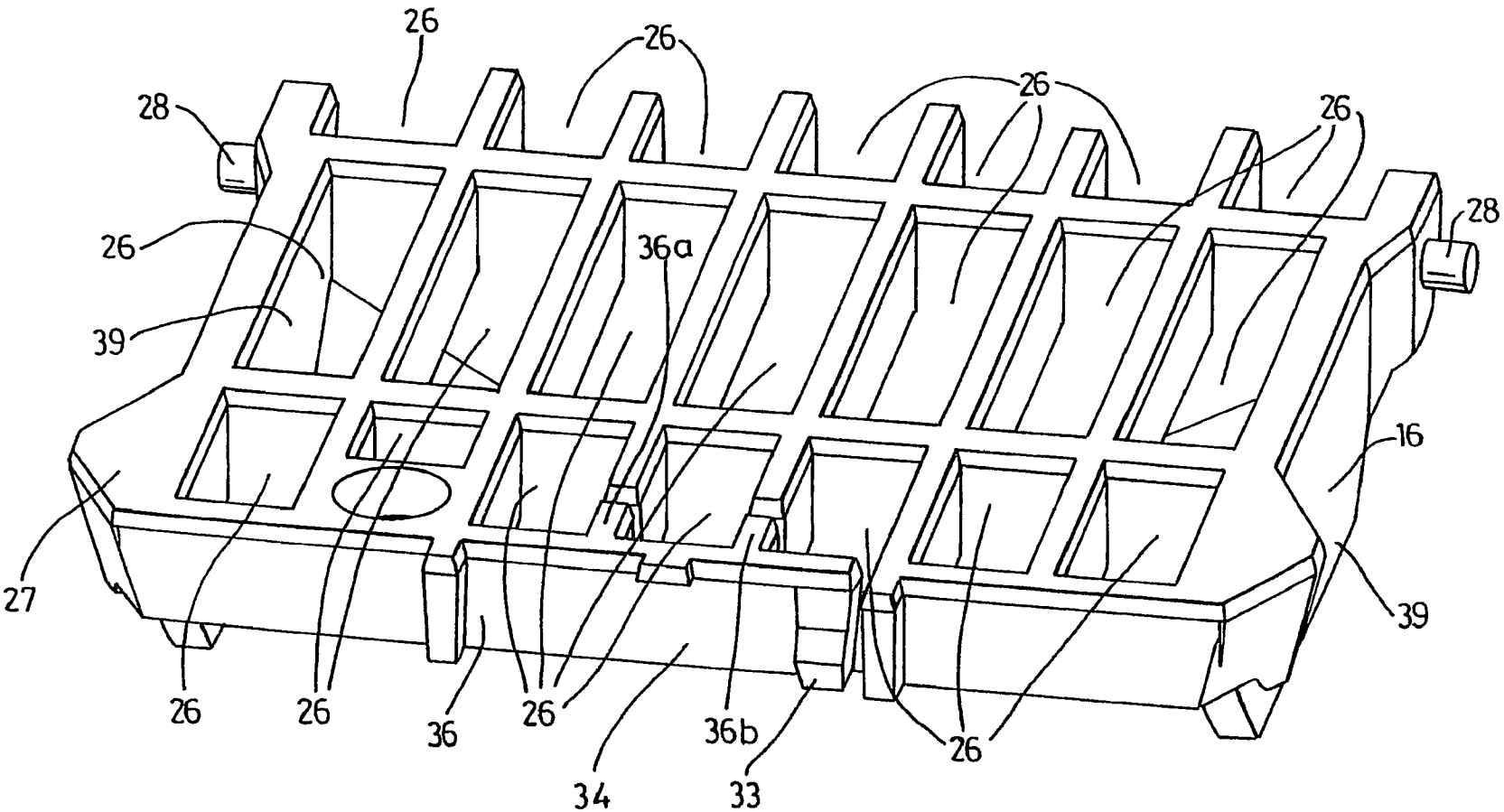
FIG. 5 is a perspective view from above of a grating manufactured in accordance with the invention.

FIGS. 3 and 4 show the features of the first frame members 12 when removed from the moulding box. FIG. 5 is a similar view of the grating 16; and FIGS. 6*a* and 6*b* show the second frame members 13, 14 respectively in a similar condition.

As shown in FIG. 5, each grating 16 defines a series of apertures 26 that are spaced from one another by a reticulated pattern of metal walls secured to and lying within a metal periphery 27.

At an in-use rear edge of the periphery 27 grating 16 includes protruding on either side thereof a cylindrical protuberance 28 that in use of the gully grate 10 functions as a trunnion.

A respective boss 29 extends inwardly of the upstanding wall 18 of the first frame member 12 in the vicinity of each frame arm end 17.

Each slot 21 lies closer to the free end of each free frame arm end 17 than the boss 29 when measured along the length of the arms of the U-shape of the first frame member 12.

Each boss 29 presents an upwardly facing shoulder 31 having formed therein a downwardly depending, generally semi-circular cup 32.

On assembly of the sub-components of the gully grate 10 together, the protuberances 28 are receivable in the respective cups 32. This step of the assembly process is effected before the lugs 24 of a second frame member 13 or 14 are located in the notches 21 of the first frame member 12. Consequently on such assembly of the first and second frame members together the closure members 23 engage the shoulders 31 of the bosses 29 thereby trapping the protuberances 28 in the cups 32. Consequently each of the protuberances serves as a trunnion that is journalled in a respective cup 32 and retained therein by a respective closure member 23. Thus the method of the invention permits the rapid formation of a robust, simple hinge for the grating 16 relative to the frame defined by the frame members 12 and 13 or 14, without any need for hinging combinations as used in the prior art.

At its end remote from the protuberances 28 the grating 16 includes projecting forwardly thereof a tongue 33 having an inclined upper surface that terminates below the upper edge of the grating.

Tongue 33 protrudes from an arm 34 that is secured at one end 36 remote from tongue 33 to the remainder of grating 16.

Although arm 36 has protruding rearwardly therefrom partial walls 36*a*, 36*b* defining part of the reticulated pattern of the grating 16, such walls are interrupted as illustrated in FIG. 5 so that the only point of attachment of arm 34 to the remainder of grating 16 is at end 36.

If as in the preferred embodiment the grating 16 is cast from so-called "nodular" iron, its material is to some extent resiliently deformable. The arrangement of the arm 34 therefore permits retracting of tongue 33 relative to the remainder of grating 16 by a short distance, against the resilience of the iron.

As best shown in FIG. 3, the "base" of the U-shape defined by upstanding wall 18 of first frame member 12 has protruding inwardly therefrom a further lug 37.

Lug 37 is located on the first frame member 12 so that when the gully grate 10 is assembled it is aligned with the location of the tongue 33.

As is visible in FIG. 9, lug 37 includes as shown an inclined lower surface 37*a* that is mateable with the inclined upper surface 33*a* of tongue 33. It will thus be apparent that on pressing of the grating 16 downwardly relative to the first frame member 12 (following assembly of the gully grate 10) the tongue 33 will engage under the lug 37 by reason of temporary resilient deformation of arm 34.

The resilience of arm 34 then forces the tongue 33 and lug 37 into a relative position in which they act as a detent mechanism. This may be either of the "active" type, in which at rest the tongue 33 and lug 37 are in contact with one another; or of the "passive" type, in which there is a small clearance between the tongue 33 and lug 37 such that they only engage one another when an attempt is made to open the grating 16.

The detent is releasable for example through the application of a prising bar against arm 34 to withdraw the tongue 33 from the further lug 37 and thereby permit hinging of the grating 16 to an open position with the protuberances 28 journalling in the cups 32.

The manufacturing method of the invention however facilitates the assembly of this arrangement, since on placing of the grating 16 into the first frame member 12 (before the positioning of a second frame member 13 or 14) the tongue 33 may be inserted under the further lug 37 (without the need for a great pressing force). Subsequent application of a second frame member 13 or 14 to the first frame member 12 results in the manufacture of a gully grate in which the grating 16 is automatically secured in its in-use position. This saves further time and effort during the manufacturing process.

Each boss 29 in the vicinity below the associated cup 32 formed therein defines a shoulder 38 that protrudes further into the interior space between the arms of the first frame member 12 than the remainder of the associated boss 29.

In use of the gully grate 10 a downwardly depending wall member 39 defining at either side of grating 16 its lateral extent rests on a said shoulder 38, whereby any forces transmitted via the grating 16 are reacted via the shoulders 38. The shoulder 38 may be of the per se known "wedging" type shown; or it may be of an also per se known "flat" type.

This makes the load bearing performance of the gully grate (that may be important for example when a vehicle drives over the gully grate) predictable, and avoids wear of the hinge defined by the protuberances 28 and cups 32.

As is best shown in FIG. 6*a*, one type of second frame member 13 according to the invention is cranked at its ends by end walls 41. The purpose of these is to space the lugs 24 forwardly relative to the remainder of the second frame member 13.

This in turn means that on assembly of the gully grate 10 the main body 42 of second frame member 13 is substantially co-terminous with the ends of the free surfaces of the frame arm ends 17.

Since this would otherwise result in a gap between the main body 42 of the second frame member 13 and the edge of the grating 16 in use of the gully grate 10, a series of pattern-continuing members in the form of teeth 22 protrude forwardly from the main body 42 in the same direction as the closure members 23 and the end walls 41 thereby continuing the reticulated pattern of walls of the grating to the edge of the frame in the vicinity of the second frame member 13.

Such an arrangement, in which the main body 42 of the second wall member 13 is co-terminus with the frame arm ends 17, is suitable for use when the gully grate 10 is to be installed in soft ground.

The alternative type of second frame member 14 is shown in FIG. 6*b*. This omits the end walls 41 such that the lugs 24 extend forwardly directly from the main body portion 42 of the second frame member 14.

By reason of the locations of the notches 21 in the first frame member 12 the arrangement of FIG. 6*b* results in the second frame member lying recessed relative to the frame arm ends 17.

This arrangement is more suitable when the gully grate 10 is to be installed adjacent a kerb, such that the second frame member 13 substantially abuts a kerbstone.

Since the second frame member 14 is recessed relative to the frame arm ends 17, the teeth 22 thereof extending from the main body portion 42 are shorter than the teeth 22 of the design of second frame member labelled 13.

Furthermore, gap-reducing protuberances in the form of additional teeth 43 protrude on the in-use outer face of second frame member 14.

The purpose of the teeth 43 is to avoid a large gap between the second frame member 14 and the kerbstone (omitted from the drawings) against which the frame arm ends 17 abut. A large gap, if present, might present a hazard to road users such as cyclists; and would permit unacceptably large pieces of debris to pass via the grating into the drain below.

As previously mentioned, the first frame member 12 includes extending from the lowermost edge of the wall 18 a flange 19.

The width of the flange 19 is greater at the corners of the first frame member 12 than in the regions intermediate the corners 44. This provides an effective keying and stabilising arrangement.

The flange 19 and wall 18 additionally are reinforced by ribs 46 spaced at intervals about the periphery of the first frame member 12 and interconnecting the flange 19 and wall 18. The ribs 46 are cast integrally with the wall 18 and flange 19.

In the vicinity of each corner region 44 the flange 19 includes on its upper and lower surfaces an array of ribs 47 defining a series of protrusions and recesses. These ribs may be mutually parallel, but this is not essential.

Such ribs, in conjunction with the widening of the flange in the vicinity of the corners 44, has been found very advantageously to confer very good strengthening and keying properties on the flange 19 and the gully grate as a whole.

In the embodiment shown the ribs 47 are straight and are parallel with one another, whereby they define a series of parallel "furrows" in the upper and lower surfaces of the corner regions 44 of the flange 19.

The ribs 47 are at each corner aligned approximately with diagonals of the aperture defined by the assembled frame of the gully grate 10.

Those of skill in the relevant art will realise that other arrangements of reinforcing and/or keying features are possible in the flange 19.

In particular it is not essential that both the upper and lower surfaces of the flange include ribs. It is also not essential that the ribs are parallel to one another or uniform as shown.

Although in the preferred embodiment of the invention the first frame member is U-shaped and the second frame member is essentially rectilinear, other arrangements of the first and second frame members are possible within the scope of the invention.

One example of such variation is for each of the first and second frame members to be L-shaped pieces that join at diagonally opposite corners of the frame on assembly of the cast article.

Also it is not essential that each of the recesses 32 is open-sided before assembly of the article. On the contrary, in some embodiments of the invention one of the recesses 32 may be closed-sided such that on insertion of the grating 16 into the frame such a closed-sided recess 32 receives a protuberance 28. The grating 16 may be then pivoted so that the other protuberance 28 enters the other recess via an opening in its side, before the second frame member is located so as to close the opening in the recess.

A further aspect of all embodiments of the invention lies in the fact that the span of the grating 16 at least longitudinally is shorter than in prior art designs. This in turn means that the grating 16 requires less by way of reinforcing features, that typically are downwardly depending ribs protruding from its underside, than prior designs. Thus the design according to the invention is for a further reason beneficial.

Thus the article and method of the invention allow the manufacture in a highly efficient manner of a very effective gully grate. Moreover the method of the invention automatically results in the assembly of the gully grate 10 in a ready to use configuration, without the need for insertion of pins or the application of pressure to close the grating to its operative position before despatch to a customer.

The invention claimed is:

1. A cast article comprising:

a frame that, in use of the article, defines an aperture, the aperture being defined by at least four vertical walls; and a further component that is, in use, retained moveably captive relative to the frame, the further component including protruding therefrom on opposite sides a pair of respective protuberances each rotatably received in a corresponding, closed-sided recess defined in the frame, the frame being assembled from first and second frame members, wherein the first frame member includes, at a location formed therein substantially coinciding with an in-use location of at least one of the protuberances, an open-sided recess having an opening in a side thereof, and the first frame member includes at least three of the vertical walls that define the aperture; and wherein the second frame member includes protruding therefrom a closure that closes the opening in the side of the open-sided recess in a manner that causes the protuberance to be rotatably retained therein to define said closed-sided recess, and the second frame member includes a single vertical wall that closes the aperture.

2. An article according to claim 1, wherein the first frame member includes formed therein two open-sided recesses each having an opening in a side thereof and respectively substantially coinciding with the in-use locations of the pair of protuberances; and the second frame member includes protruding therefrom a pair of closures that respectively close the opening in a side of said open-sided recess thereby defining a pair of the closed sided recesses.

3. An article according to claim 1, wherein the first frame member includes formed therein one or more slots, that are each open at an edge of the first frame member, having received therein a part of the second frame member so as to locate the second frame member relative to the first frame member.

4. An article according to claim 1, wherein the first and second frame members are secured one to the other.

5. An article according to claim 4, wherein the first and second frame members are welded together.

6. An article according to claim 1, wherein the first frame member defines two frame arm ends; and said second frame member includes one or more formations that are engageable with the first frame member to determine the spacing of said second frame member relative to the frame arm ends of first frame member.

7. An article according to claim 6, wherein the second frame member includes at either end a cranked portion defining respective said formations, whereby a major part of the second frame member lies generally coterminous with the frame arm ends thereof.

8. An article according to claim 6, wherein the second frame member includes at each end a planar portion defining respective said formations whereby the second frame member is spaced from the frame arm ends.

9. An article according to claim 1, wherein the further component is or includes a reticulated grating.

10. An article according to claim 9, wherein the reticulated grating includes one or more elongate members that are arranged in a reticulated pattern; and protruding therefrom towards the grating one or more pattern-continuing protuberances that continue at least part of the reticulated pattern beyond the extent of the grating.

11. An article according to claim 9, wherein the second frame member includes protruding therefrom away from the grating one or more gap-reducing protuberances.

12. An article according to claim 1, wherein the first frame member includes a flange extending outwardly of the periphery of the frame.

13. An article according to claim 1, wherein the second frame member includes a flange extending outwardly of the frame.

14. An article according to claim 12, wherein a width of the flange of the first frame member varies from place to place about a periphery of the frame.

15. An article according to claim 12, wherein the flange includes formed thereon one or more protrusions and/or recesses for stiffening the article and for aiding keying of the flange in a bedding medium.

16. An article according to claim 15, wherein the protrusions and/or recesses are formed on an in-use upper surface and/or an in-use lower surface of the flange.

17. An article according to claim 1, wherein said first frame member or said second frame member includes formed therein at least one support and said further component includes at least one formation for engaging the support when the further component occupies a first position relative to the frame.

18. An article according to claim 1, wherein said first frame member or said second frame member and the further component define a detent for releasably retaining the further component in a first position relative to the frame.

19. An article according to claim 18, wherein the further component includes a resiliently deformably mounted tongue and the frame includes a lug with which the tongue is selectively engageable releasably to retain the further component in said first position.

20. An article according to claim 1, wherein the article is a gully grate.

21. An article according to claim 13, wherein a width of the flange of the second frame member varies from place to place about a periphery of the frame.

22. A cast article comprising:

a first frame member that defines three vertical walls of an aperture of the article in an assembled state, the aperture being defined by at least four vertical walls;

a second frame member that defines a fourth vertical wall of the aperture of the article in the assembled state, the fourth vertical wall closing the aperture; and a further component that is, in the assembled state, retained within the aperture of the article by the first and second frame members so as to be rotatable relative to the first and second frame members, the further component including protruding therefrom on opposite sides a pair of respective protuberances each rotatably received in a corresponding recess defined in the first frame member, the recess including two openings on adjacent sides thereof prior to the second frame being assembled to the first frame, wherein the second frame member includes, protruding therefrom, a pair of closure members that, in the assembled state, respectively extend over a first one of the two openings on adjacent sides of the corresponding recess of the first frame member so as to close the first one of the two openings and retain the further component captive relative to the first and second frame members.

23. An article according to claim 22, wherein the first frame member includes formed therein one or more slots, that are each open at an edge of the first frame member, having received therein a part of the second frame member so as to locate the second frame member relative to the first frame member.

24. An article according to claim 22, wherein the first and second frame members are welded together in the assembled state.

25. An article according to claim 22, wherein the first frame member includes two frame arm ends, and the second frame member includes one or more formations that are engageable with the first frame member to determine the spacing of said second frame member relative to the frame arm ends of first frame member.

26. An article according to claim 25, wherein the second frame member includes at either end a cranked portion defining respective said formations, whereby a major part of the second frame member lies generally coterminous with the frame arm ends thereof.

27. An article according to claim 25, wherein the second frame member includes at each end a planar portion defining respective said formations whereby the second frame member is spaced from the frame arm ends.

28. An article according to claim 22, wherein the further component is or includes a reticulated grating.

29. An article according to claim 28, wherein the reticulated grating includes one or more elongate members that are arranged in a reticulated pattern; and protruding therefrom towards the grating one or more pattern-continuing protuberances that continue at least part of the reticulated pattern beyond the extent of the grating.

30. An article according to claim 28, wherein the second frame member includes protruding therefrom away from the grating one or more gap-reducing protuberances.

31. An article according to claim 22, wherein the first frame member includes a flange extending outwardly of the periphery of the frame.

32. An article according to claim 22, wherein the second frame member includes a flange extending outwardly of the frame.

33. An article according to claim 31, wherein a width of the flange of the first frame member varies from place to place about a periphery of the frame.

34. An article according to claim 32, wherein a width of the flange of the second frame member varies from place to place about a periphery of the frame.

35. An article according to claim 22, wherein said first frame member or said second frame member includes formed therein at least one support and said further component includes at least one formation for engaging the support when the further component occupies a first position relative to the frame.

36. An article according to claim 22, wherein said first frame member or said second frame member and the further component define a detent for releasably retaining the further component in a first position relative to the frame.

37. An article according to claim 36, wherein the further component includes a resiliently deformably mounted tongue and the frame includes a lug with which the tongue is selectively engageable releasably to retain the further component in said first position.

* * * * *